US005158185A

United States Patent [19]

Michael et al.

[11] Patent Number: 5,158,185

[45] Date of Patent: Oct. 27, 1992

[54] DIVIDERS FOR DISHWASHER RACKING SYSTEM

[75] Inventors: Daryl A. Michael; Dennis L. Purtilo, both of Newton, Iowa

[73] Assignee: Maytag Corporation, Newton, Iowa

[21] Appl. No.: 767,017

[22] Filed: Sep. 27, 1991

[51] Int. Cl.[5] ..... A47G 19/02

[52] U.S. Cl. ..... 211/41; 211/151; 312/311; 134/201; 134/200

[58] Field of Search ..... 211/41, 208, 181, 151; 312/311; 134/200, 201, 144, 135

[56] References Cited

U.S. PATENT DOCUMENTS

| | | | |
|---|---|---|---|
| 1,822,087 | 9/1931 | Feingold . | |
| 1,971,523 | 8/1934 | Feingold . | |
| 2,516,088 | 7/1950 | Einhorn . | |
| 2,689,576 | 9/1954 | Colstad . | |
| 2,708,037 | 5/1955 | Planeta . | |
| 2,710,617 | 6/1955 | James et al. | 211/411 |
| 2,971,668 | 2/1961 | Peglow . | |
| 3,084,702 | 4/1963 | Nasser . | |
| 3,098,685 | 7/1963 | Stiner et al. | 312/311 |
| 3,126,098 | 3/1964 | Geiger et al. . | |
| 3,181,924 | 5/1965 | Guth . | |
| 3,269,548 | 8/1966 | Geiger et al. . | |
| 3,402,975 | 9/1968 | Smith . | |
| 3,464,566 | 9/1969 | Gilson | 211/41 X |
| 3,472,573 | 10/1969 | Geiger . | |
| 3,612,285 | 10/1971 | Mason . | |
| 3,752,322 | 8/1973 | Fiocca et al. . | |
| 4,046,261 | 9/1977 | Yake . | |
| 4,183,437 | 1/1980 | Crawford et al. . | |
| 4,475,656 | 10/1984 | Collier . | |
| 4,606,464 | 8/1986 | Jordan et al. . | |
| 4,917,248 | 4/1990 | Friskney . | |

FOREIGN PATENT DOCUMENTS

| | | | |
|---|---|---|---|
| 3022484 | 1/1982 | Fed. Rep. of Germany | 211/41 |
| 3110299 | 10/1982 | Fed. Rep. of Germany | 211/41 |
| 1027001 | 4/1966 | United Kingdom | 211/41 |

OTHER PUBLICATIONS

European Patent Application, 372,342 Jun. 6, 1990.

O'Keefe & Merrit, "Dishwashers" (one page illustration) date unknown.

Whirlpool, "Dishwashers/Compactors" Form No. 8SH91 (three pages) date unknown.

GE Dishwashers, "Built-in Dishwashers" Pub. No. 5S10 (three pages) date unknown.

Amana, "Masterclean Dishwashers" Models DU9010W and DU9010B, Form No. 0120 (three pages) 1990.

White-Westinghouse "Dishwashers" Models SU980J, SU770J, SU550J, SU330J, SU210J, SC560J (four pages), W88DW0403-1988.

*Primary Examiner*—Frankie L. Stinson

*Attorney, Agent, or Firm*—Richard L. Ward

[57] ABSTRACT

A dishwasher having a unique racking system mounted therein is provided. The dish racking system includes a lower rack having a side wall extending substantially higher than the front, rear and other side walls to define a protective barrier between a side panel of the washing chamber and various large articles placed adjacent the side wall for washing. An upper rack is supported above the lower rack. The upper rack has a bottom support means including at least one upwardly stepped portion adjacent the high side wall of the lower rack. A pivotal shelf is located generally intermediate the bottom support wall and the upper edge of the high side wall of the lower rack. A pivotal shelf can be similarly provided in the upper rack. Attachable to either the lower or upper rack is a divider means. The divider means includes means for pivotally mounting a pair of the divider means on the bottom wall of either the upper or lower racks. Each of the divider means includes a first plurality of pegs and a second plurality of pegs. The first plurality of pegs has a peg configuration and spacing for supporting a first type of dishes. The second plurality of pegs has a peg configuration and spacing for supporting a second type of dishes. The pair of divider means are pivotal between a first and a second position for selectively supporting either the first or second types of dishes.

11 Claims, 7 Drawing Sheets

DIVIDERS FOR DISHWASHER RACKING SYSTEM

BACKGROUND OF INVENTION

1. FIELD OF THE INVENTION

The present invention is generally directed to a dishwasher having an enclosure defining a washing chamber and a dish racking system mounted therein, and more particularly, to a dish racking system having various configurations that enhance the loading flexibility of the dishwasher.

2. DESCRIPTION OF THE PRIOR ART

In the design of dishwasher racks it has generally been industry practice to design racks with dish support members arranged for loading standard dishes such as dinner plates. Some articles, however, can not be loaded like standard articles and require special consideration. In addition, the loading requirements may vary from use to use. In some cases the dishwasher is loaded with standard articles such as dinner plates and cups. In other cases the dishwasher is loaded with nonstandard articles such as pans and bowls. To alleviate the problem associated with loading various odd shaped articles, several rack designs have evolved which include movable or adjustable portions.

U.S. Pat. Nos. 1,822,087 and 1,971,523 (Feingold) disclose a dish drainer that opens to accommodate itself to different sizes of dishes and is folded up when the dish drainer is not in use.

U.S. Pat. No. 2,516,088 (Einhorn) discloses a folding dish-drying rack which is folded after use to conserve storage space.

U.S. Pat. No. 2,689,576 (Colstad) illustrates an upper dish rack having a side wall angled to allow large or oversized articles to be placed along one side of the lower dish rack.

U.S. Pat. No. 2,708,037 (Planeta) discloses a detachable rack which can be secured along one side of a conventional wire dish drainer. A clamp maintains the rack in a vertical position. Cups and glasses are placed on the detachable rack so that they are supported outside the dish drainer thereby increasing the capacity of the dish rack.

U.S. Pat. No. 2,971,668 (Peglow) discloses a dish rack that includes inserts releasably secured to the dish rack framework.

U.S. Pat. No. 3,084,702 (Nasser) discloses an article support means located above the nozzle tunnel to support smaller articles.

U.S. Pat. No. 3,181,924 (Guth) discloses a stepped upper rack to accommodate large articles along one side of the lower rack.

U.S. Pat. No. 3,126,098 (Geiger et al.) discloses a movable divider hinged to a bottom wire by looping the ends of the divider around the bottom wire. The divider can be positioned in either an upright or folded-down position.

U.S. Pat. No. 3,269,548 (Geiger et al.) discloses a rack system which is vertically adjustable within the dishwasher to accommodate large articles. The upper rack also includes several pivoted divider members Each of the pivoted divider members is formed of wire members and is supported on the upper rack by a pair of hinge clips secured to the base of the wire rack for supporting the ends of the pivoted divider members A separate sheet metal detent member is positioned at the end of the rack for holding the pivoted divider members in the upright position.

U.S. Pat. No. 3,402,975 (Smith) discloses a top loading dishwasher having two levels of dish racks. Access to the lower dish rack is attained by utilizing a horizontally movable rack in cooperation with a hinged shelf which is pivotally supported between a pair of the dishwasher side walls at one end and by a portion of the movable rack at the other end. The hinged shelf includes a pair of pivotal divider assemblies each of which may be maintained in an upright posture by a detent assembly at one end of the divider assembly.

U.S. Pat. No. 3,472,573 (Geiger) discloses a rack adjustment system for vertically adjusting either side of the upper rack to accommodate larger articles on the lower rack.

U.S. Pat. No. 3,612,285 (Mason) discloses a racking system that holds articles being washed by upwardly projected sprays of liquid by providing a pivotal retainer for engaging the articles.

U.S. Pat. No. 3,752,322 (Fiocca et al.) discloses a dishwasher rack construction in which a pivoted element can be retained in one of a plurality of intermediate positions by an arcuate toothed member located at the front of the rack.

U.S. Pat. No. 4,046,261 (Yake) discloses a dishwasher rack which includes a pair of brackets fixed to the bottom of the rack and having molded slots and retainers for receiving a plurality of fences in a plurality of positions. These fences are either vertically mounted between the pair of brackets or are removed from the dishwasher rack. There is no pivotal movement of individual fences but only selective use of these fences for adjusting the distance between adjacent fences and between the rack side walls.

U.S. Pat. No. 4,183,437 (Crawford et al.) discloses the use of alternating pairs of article supports for optional racking of plates and bowls while maximizing the capacity of the dish rack.

U.S. Pat. No. 4,606,464 (Jordan et al.) discloses a pivoted divider which can be positioned in either an upright or folded position. A combination camming and biasing member is integral with a support member and is engageable with a portion of the pivoted divider for biasing the divider in either the upright or folded-down position.

U.S. Pat. No. 4,917,248 (Friskney) discloses a dishwasher rack with a movable fence which can be moved between a folded or inoperative position where it extends parallel to the bottom wall of the rack and an upright or operating position.

Accordingly, it is a primary object of the present invention to provide a dish racking system that provides for increased load capacity by providing at least one pivotal shelf.

Another object of the present invention is to provide an improved dishwasher rack with pivoted divider members which can be rotated to accommodate either standard or non-standard articles.

A still further object is to provide a high sided lower rack to support tall articles while protecting those articles and the dishwasher chamber from damage.

Further objects and advantages will become apparent from the following description and the accompanying drawings.

SUMMARY OF THE INVENTION

Briefly, the instant invention achieves these objects in a dishwasher having a unique racking system mounted therein. The dish racking system includes a lower rack having a bottom support and a front, a rear and a first and second side walls. The first side wall extends substantially higher than the front, rear and second side walls to define a protective barrier between a side panel of the washing chamber and various large articles placed adjacent the first side wall for washing. An upper rack is supported above the lower rack by a rack mount associated with opposed side panels of the washing chamber. The upper rack has its bottom support upwardly stepped above the first side wall of the lower rack. A pivotal shelf is located generally intermediate the bottom support wall and the upper edge of the first side wall of the lower rack. The shelf is spaced laterally inward from the first side wall and forms a front-to-rear gap therebetween in one position of the shelf for supporting selected articles to be washed. A pivotal shelf can be similarly provided in the upper rack.

A pair of dividers are pivotally mounted on the bottom support of either the lower or upper rack. Each divider includes an axle portion having a first and a second plurality of pegs extending generally radially from the axle portion. The first plurality of pegs has a peg configuration and spacing for supporting standard articles and the second plurality of pegs has a peg configuration and spacing for supporting non-standard articles The pair of dividers are pivoted to place either the first or second plurality of pegs in position to support either standard or non-standard articles.

BRIEF DESCRIPTION OF THE DRAWINGS

Further objects and advantages of this invention will become more apparent and readily appreciated from the following detailed description of the present invention, taken in conjunction with the accompanying drawings, of which.

DETAILED DESCRIPTION OF THE PRESENTLY PREFERRED EMBODIMENTS

Figure 1:
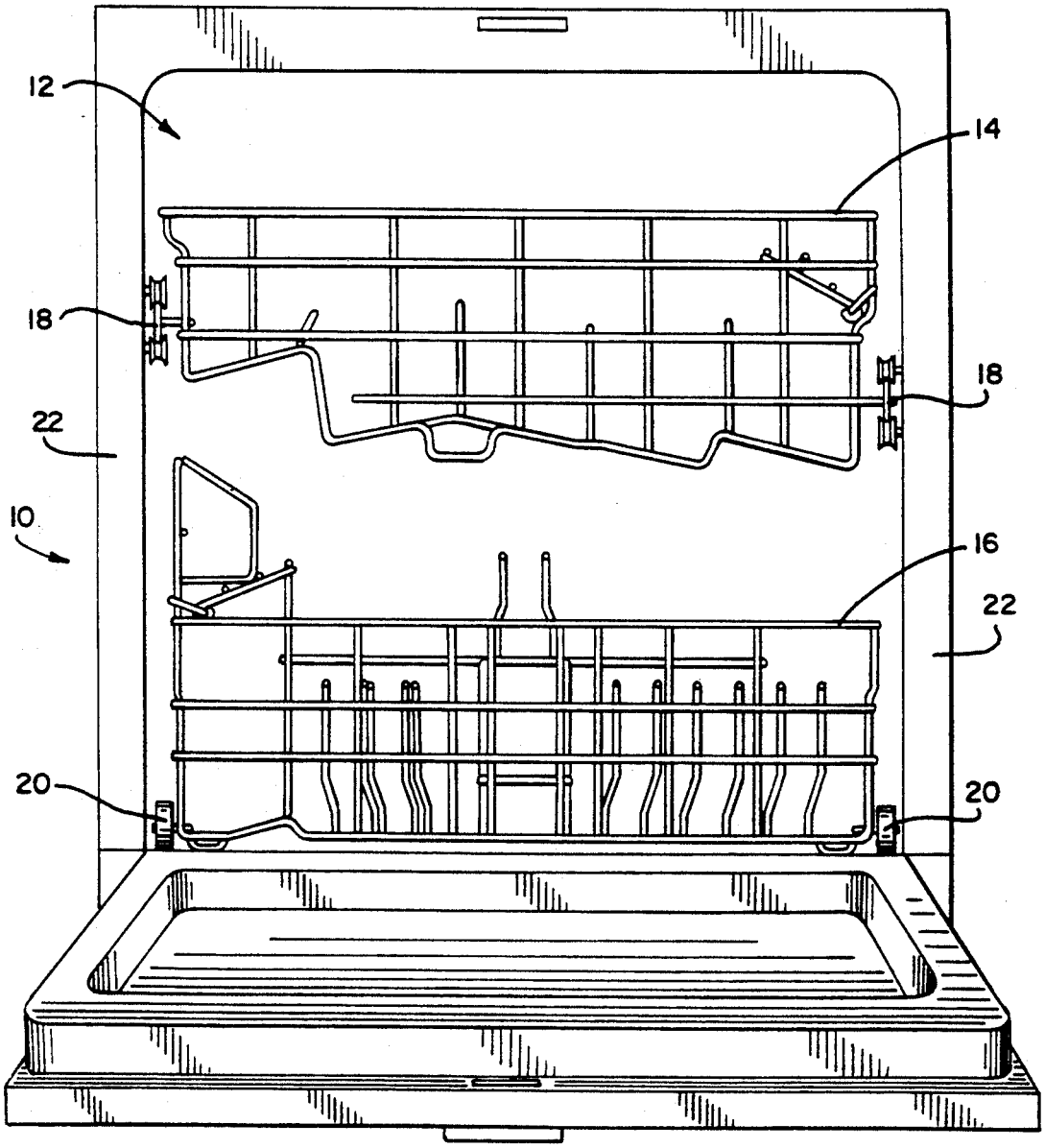
FIG. 1 is a front view of a dishwasher with the dishwashing chamber exposed.

FIG. 1 is a front view of a dishwasher 10 having a dishwashing chamber 12 therein. Mounted inside the dishwashing chamber 12 is an upper dish rack 14 and a lower dish rack 16. The upper dish rack 14 is mounted to the dishwashing chamber 12 by a track and roller assembly 18 located on opposite side panels 22 of the dishwashing chamber 12. Various track and roller assemblies can be used and are known to those skilled in the art. The track and roller assembly 18 located on one side panel 22 of the dishwashing chamber 12 is vertically offset from the track and roller assembly 18 located on the opposite side panel 22 of the dishwashing chamber 12 to provide maximum racking space in the lower rack 16. The lower dish rack 16 rolls in and out of the dishwashing chamber 12 on wheels 20.

Figure 2:
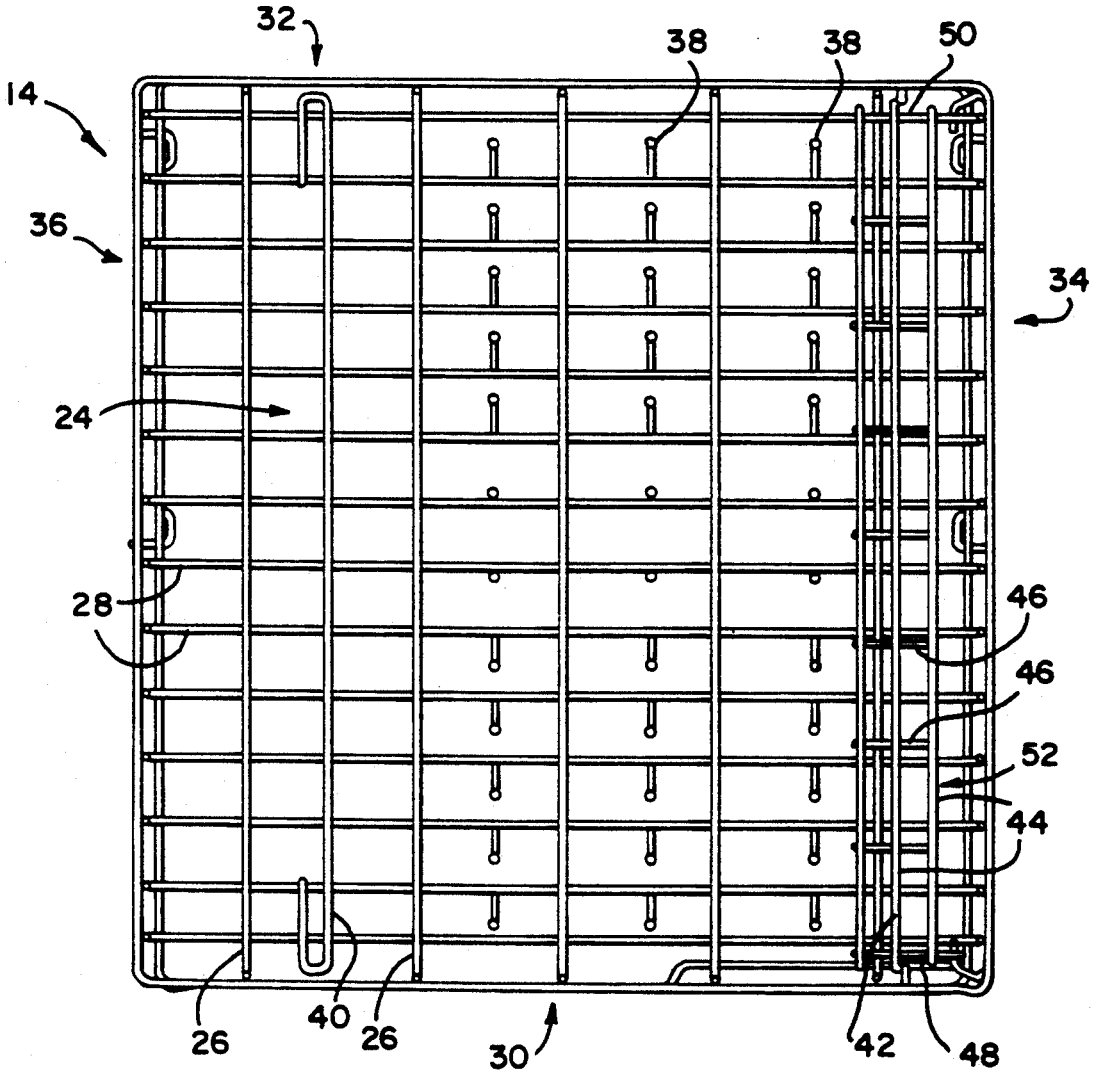
FIG. 2 is a top view of an upper dish rack.

FIG. 2 is a top view of the upper dish rack 14. The dish rack 14 has a bottom support means 24 formed by a plurality of spaced-apart longitudinal wire members 26 and lateral wire members 28. Enclosing the bottom support means 24 are a front wall 30, a back wall 32 and side walls 34 and 36. The front, back and side walls are generally formed by longitudinal and lateral wire members extending generally perpendicular from the bottom support means 24. Pegs 38 extend perpendicularly from the bottom support means 24. The pegs 38 are formed by wire members attached to the bottom support means 24. A restraining member 40 formed by a longitudinal wire member extends longitudinally across the bottom support means 24. Attached to side wall 34 is a pivotal shelf 42. The pivotal shelf 42 is formed by longitudinal wire members 44, lateral wire members 46 and a first and a second wire member 48 and 50. The lateral wire members 46 extend between the longitudinal wire members 44. The first and second wire members 48 and 50 attach the pivotal shelf 42 to the side wall 34. The pivotal shelf 42 can be pivoted from a first position to a second position When the pivotal shelf 42 is in the first position as illustrated in FIGS. 2–4, a gap 52 exists between the pivotal shelf 42 and the side wall 34.

Figure 3:
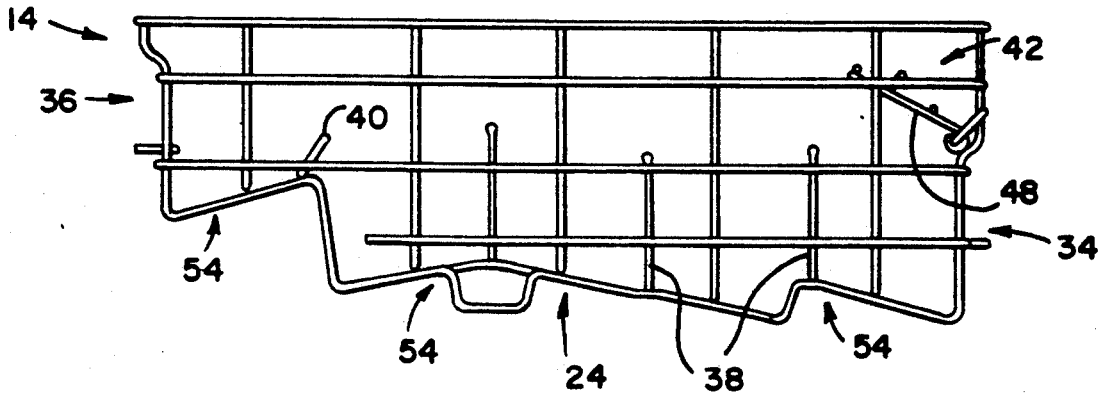
FIG. 3 is a front view of the upper dish rack illustrated in FIG. 2.

FIG. 3 is a front view of the upper rack 14 illustrated in FIG. 2. The bottom support means 24 is formed by upwardly stepped portions 54. Although several upwardly stepped portions 54 are illustrated, only one upwardly stepped portion is required adjacent the side wall 36 as will be described with respect to FIGS. 6–9. The pegs 38 are generally perpendicular to the bottom support means 24 and the restraining member 40 is angled with respect to the bottom support means 24. The pivotal shelf 42, illustrated positioned in the first position, is inclined with respect to the side wall 34 at an angle of approximately 20°. The pivotal shelf 42 is angled so that articles placed on the pivotal shelf 42 are supported by either the pivotal shelf 42 alone or within the gap 52 between the pivotal shelf 42 and the side wall 34.

Figure 4:
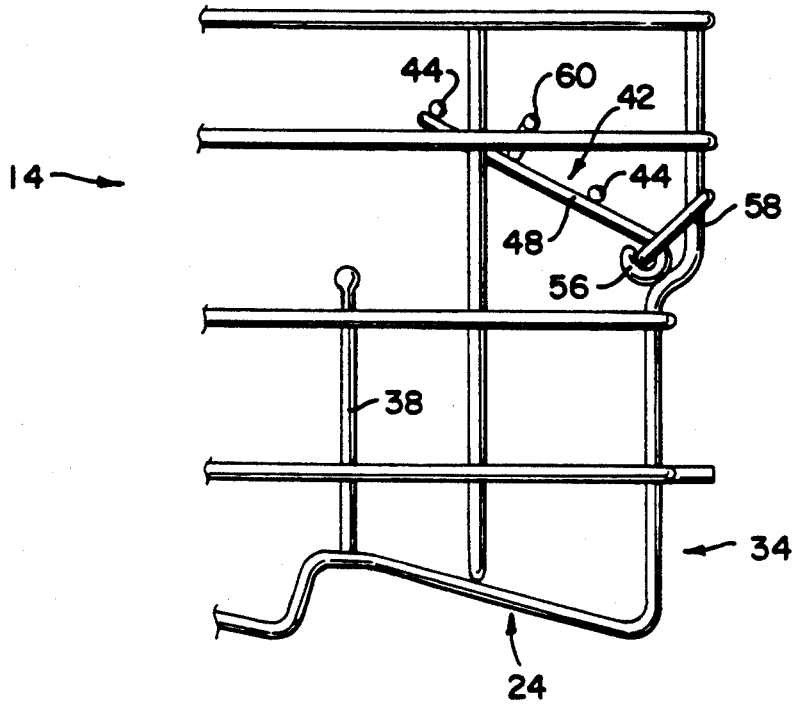
FIG. 4 is a partial front view of a pivotal shelf mounted to the upper dish rack in a first position.

FIG. 4 is a partial front view of the pivotal shelf 42 mounted to the upper rack 14 in a first position As illustrated in FIG. 2, the lateral members 46 extend between the longitudinal members 44. The first and second wire members 48 and 50 are longer than the lateral members 46 in order to attach the pivotal shelf 42 to the side wall 34. The first and second wire members 48 and 50 are provided with an attaching means in the form of a hook 56. The hook 56 is wrapped around a support 58 provided in the side wall 34. When the pivotal shelf 42 is in the first position, a stop 60 is provided to hold the pivotal shelf 42 in the first position The stop 60 rests upon a lateral member in the front wall 30. Although not illustrated, a similar stop is provided on the second wire member 50 which rests upon a lateral member in the back wall 32. The pivotal shelf 42 is maintained at an angle of about 20°-25° from horizontal when it is in the first position so that articles placed on the pivotal shelf 42 are less likely to move or fall off the pivotal shelf 42. Placing the pivotal shelf 42 in the first position increases the capacity of the upper rack 14 so that articles can be placed on as well as beneath the pivotal shelf 42.

Figure 5:
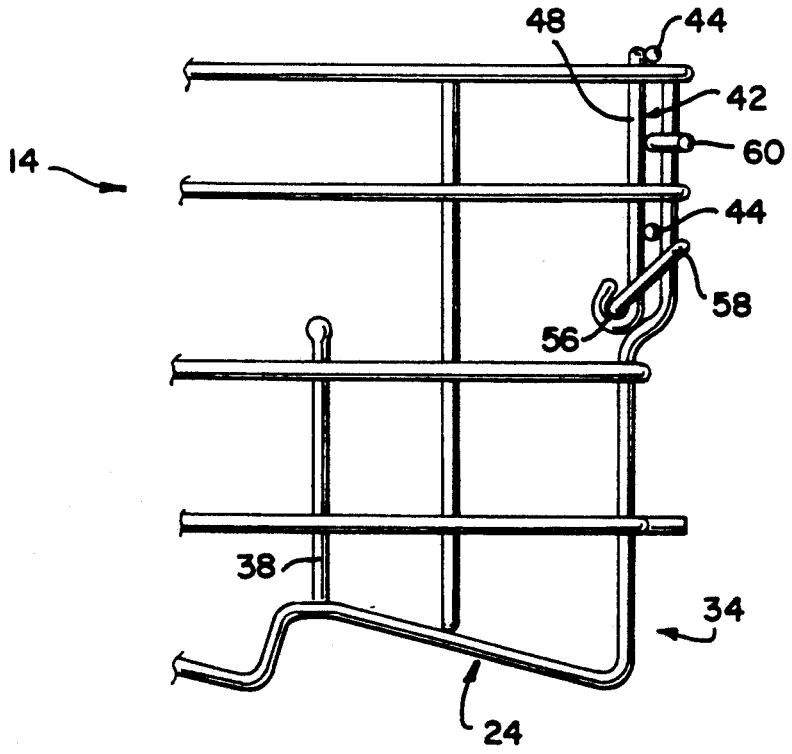
FIG. 5 is a partial front view of the pivotal shelf shown in FIG. 4 in a second position.

FIG. 5 is a partial front view of the pivotal shelf 42 in a second position. In the second position, the pivotal shelf 42 is parallel and adjacent to the side wall 34. When the pivotal shelf 42 is in the second position, taller articles can be placed on the bottom support means 24 next to the side wall 34.

The upper rack 14 is thus flexible to accommodate various load requirements. Placing the pivotal shelf 42 in the first position increases the capacity of the upper rack 14 so that more articles can be placed on the pivotal shelf 42 as well as under the pivotal shelf 42. Placing the pivotal shelf 42 in the second position allows taller articles to be washed.

Figure 6:
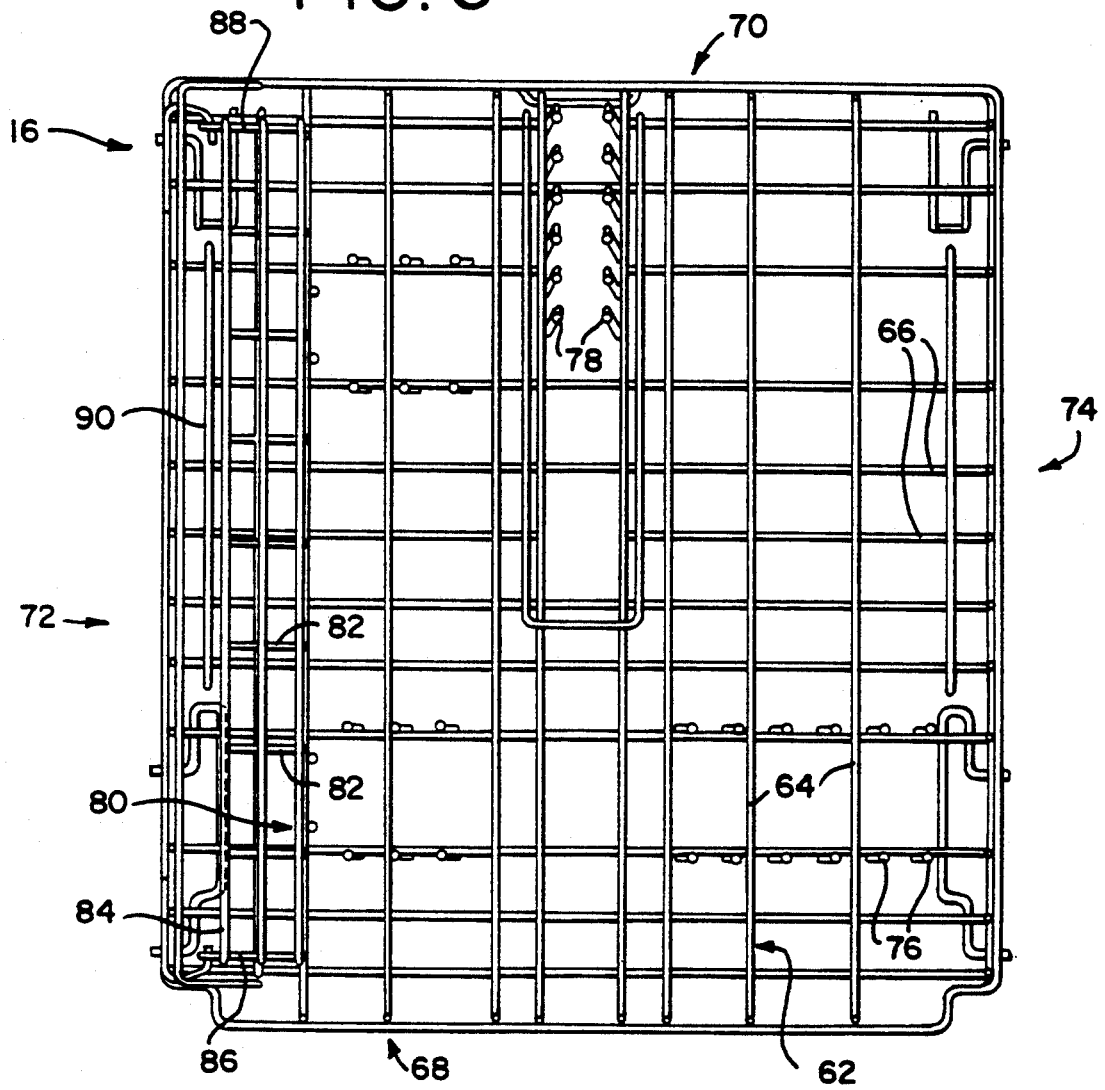
FIG. 6 is a top view of a lower dish rack.

FIG. 6 is a top view of the lower dish rack 16. The lower dish rack 16 has a bottom support means 62 formed by a plurality of spaced-apart longitudinal wire members 64 and lateral wire members 66. Enclosing the bottom support means 62 is a front wall 68, a back wall 70 and side walls 72 and 74. The front wall 68, back wall 70 and side walls 72 and 74 are formed by longitudinal and lateral wire members extending generally perpendicularly from the bottom support means 62. Pegs 76 extend generally perpendicularly from the bottom support means 62. The pegs 76 are formed by wire members connected to the bottom support means 62. A plurality of pegs 78 are provided along the nozzle tunnel of the lower dish rack 16. The side wall 72 is higher than the side wall 74, the purpose for which will be described with respect to FIGS. 7 and 8. Attached to the side wall 72 is a pivotal shelf 80. The pivotal shelf 80 has lateral wire members 82, longitudinal wire members 84 and a first and a second wire member 86 and 88. The lateral wire members 82 extend between the longitudinal wire members 84. The first and second wire members 86 and 88 attach the pivotal shelf 80 to the side wall 72. The pivotal shelf 80 can be pivoted from a first position as illustrated in FIG. 8 to a second position further described with respect to FIG. 9. When the pivotal shelf 80 is in the first position, a gap 90 is provided between the pivotal shelf 80 and the side wall 72. The gap 90 allows large articles such as cookie sheets and pizza pans to be placed between the pivotal shelf 80 and the side wall 72. In addition, the high side wall 72 protects the articles placed adjacent to the side wall 72 from contacting the side walls of the dishwashing chamber 12 (shown in FIG. 1).

Figure 7:
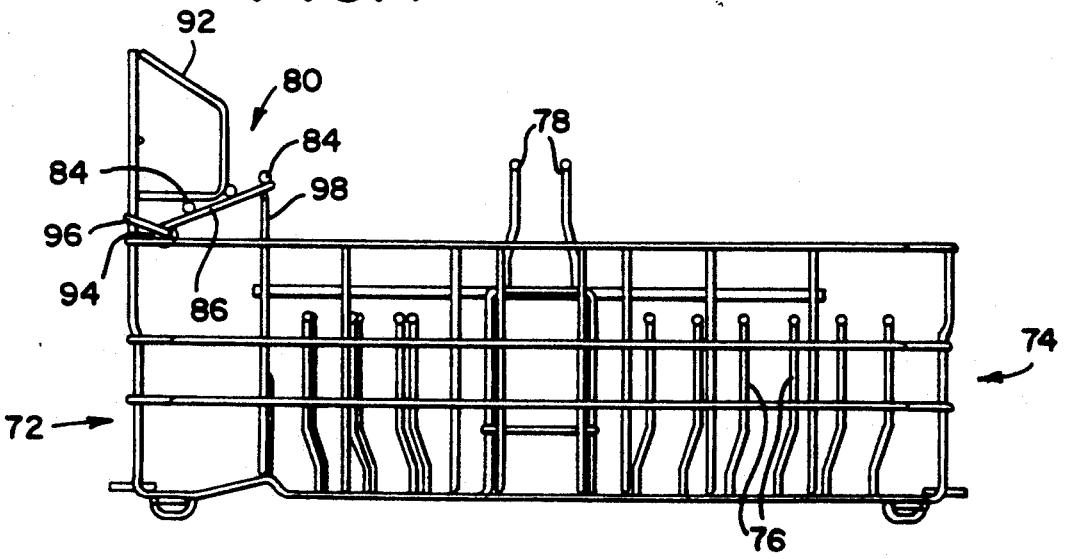
FIG. 7 is a front view of the lower dish rack illustrated in FIG. 6.
Figure 8:
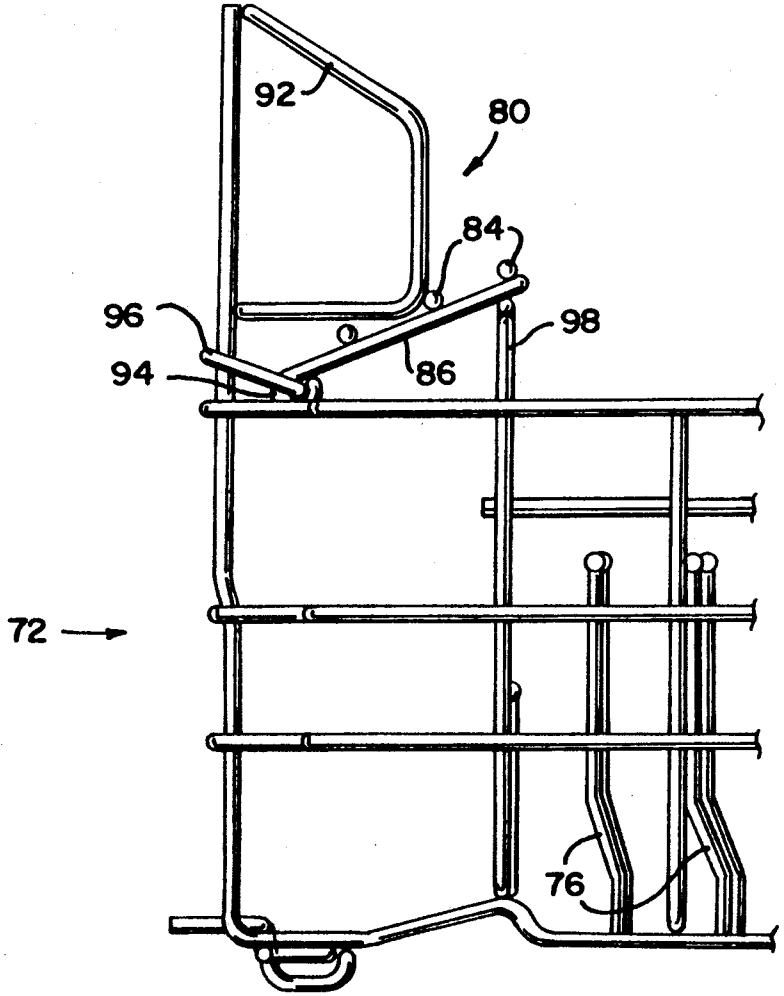
FIG. 8 is a partial front view of a pivotal shelf mounted in the lower rack in a first position.

FIG. 7 is a front view of the lower rack 16 illustrated in FIG. 6. The side wall 72 is higher than the side wall 74. Wings 92 extend perpendicularly from the side wall 72 to form an extension of the front and back walls 68 and 70. The wings 92 are formed from wire members.

FIG. 8 is a partial front view of lower rack 16 showing the pivotal shelf 80 mounted to the lower rack 16 in a first position The pivotal shelf 80 is formed by longitudinal wire members 84, lateral members 82 (shown in FIG. 6) and a first wire member 86 and a second wire member 88 (shown in FIG. 6). The first wire member 86 and the second wire member 88 attach the pivotal shelf 80 to the side wall 72. As illustrated in FIG. 6, the lateral members 82 extend between longitudinal members 84. The first and second wire members 86 and 88 are longer than the lateral members 82 in order to attach the pivotal shelf 80 to the side wall 72. The first and second members 86 and 88 are provided with an attaching means in the form of a hook 94. The hook 94 is wrapped around a support 96 provided in the side wall 72. When the pivotal shelf 80 is in the first position as illustrated, a stop 98 is provided to support the pivotal shelf 80 in the first position. The stop 98 is a wire member extending generally perpendicularly from the bottom support means 62. Although not illustrated, similar stops are provided along the length of the bottom support means 62. The pivotal shelf 80 is supported at an angle of approximately 20° from horizontal when it is in the first position so that articles placed on the pivotal shelf 80 are less likely to move or fall off the pivotal shelf 80.

Figure 9:
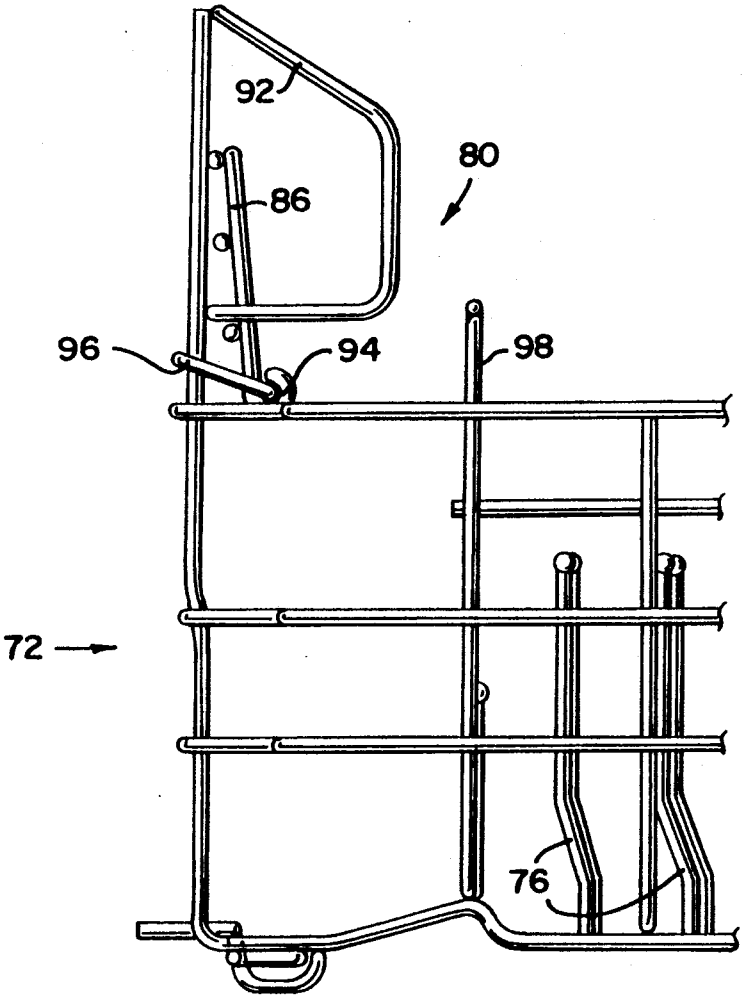
FIG. 9 is a partial front view of the pivotal shelf shown in FIG. 8 in a second position.

FIG. 9 is a partial front view of lower rack 16 showing the pivotal shelf 80 in a second position In the second position, the pivotal shelf 80 is generally parallel and adjacent to the side wall 72. When the pivotal shelf 80 is in the second position, taller articles such as pizza pans and cookie sheets can be placed next to the side wall 72.

The lower rack 16 is thus able to accommodate various load requirements. Placing the pivotal shelf 80 in the first position increases the capacity of the lower rack 16 so that more articles can be placed on the pivotal shelf 80 as well as under the pivotal shelf 80. Placing the pivotal shelf 80 in the second position allows taller articles to be washed.

The present invention provides various configurations to accommodate varying load requirements. The upper rack 14 has a pivotal shelf 42 which when rotated to a first position allows articles to be placed on the pivotal shelf 42 as well as under the pivotal shelf 42. If taller articles are to be washed, the pivotal shelf 42 is rotated to a second position so that it is generally parallel and adjacent to the side wall 34. The upper rack 14 also has a restraining member 40 which in combination with an upwardly stepped portion 54 of the bottom support means 24 inhibits articles placed adjacent to the side wall 36 from falling off of the upwardly stepped portion 54. In addition, the restraining member 40 allows articles to be supported against it and protects those articles from coming in contact with articles placed adjacent to the side wall 36. The side wall 36 of the upper rack 14 is shorter than the side wall 34 to provide clearance for the lower rack 16 which has a high side wall 72.

The lower rack 16 also has a pivotal shelf 80 which when rotated to the first position allows articles to be placed on and underneath the pivotal shelf 80. In addition, a gap 90 exists between the pivotal shelf 80 and the side wall 72 to accommodate tall articles such as baking sheets and pizza pans which can be placed between the pivotal shelf 80 and the side wall 72. If taller articles are to be washed, the pivotal shelf 80 is rotated to a second position so that it is generally parallel and adjacent to the side wall 72. The high side wall 72 protects the articles placed adjacent to the side wall 72 from contacting the dishwashing chamber 12. This protects the articles as well as the dishwashing chamber 12 from damage.

Figure 10:
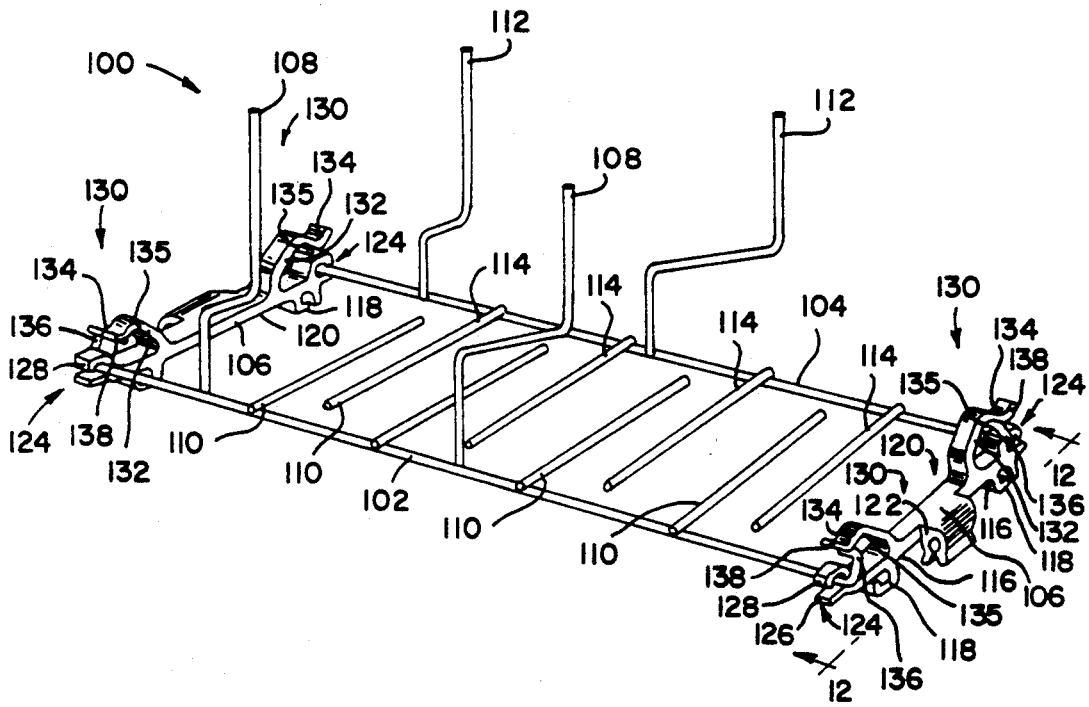
FIG. 10 illustrates a pivoted divider member configured in a first position.
Figure 11:
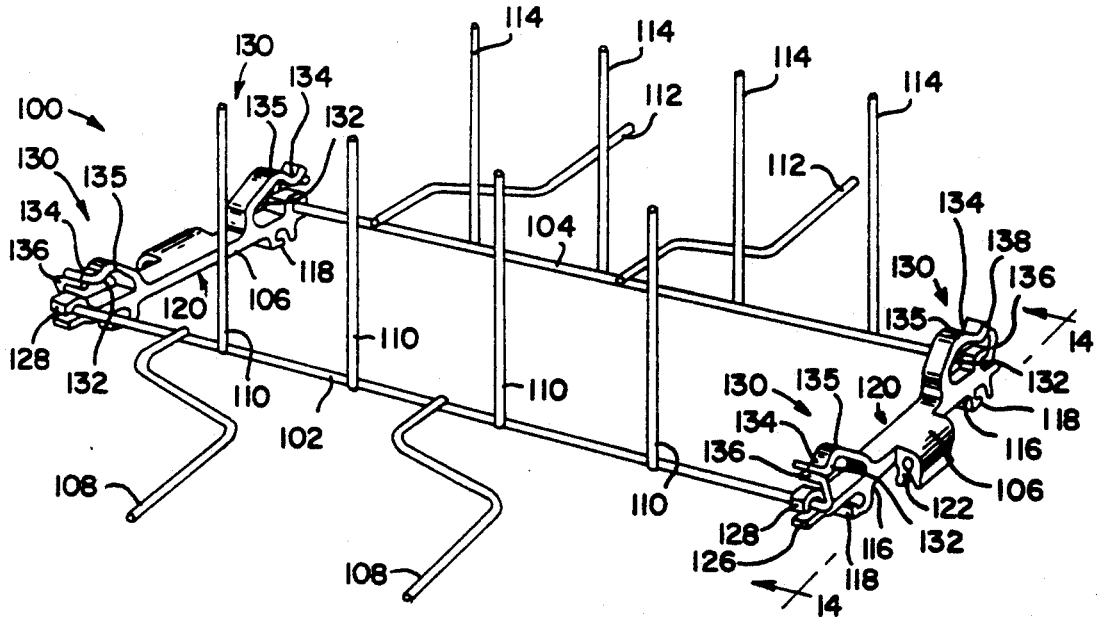
FIG. 11 illustrates the pivoted divider member configured in a second position.

FIGS. 10 and 11 illustrate pivoted divider members 100 configured in a first position and a second position respectively. The pivoted divider members 100 include a first axle 102 and a second axle 104 connected by pivot support members 106. A first set of pegs 108 and a second set of pegs 110 are generally alternately attached to the first axle 102. Similarly, a first set of pegs 112 and a second set of pegs 114 are generally alternately attached to the second axle 104. It is not necessary that the first and the second sets of pegs alternate along the entire length of an axle. The first sets of pegs 108 and 112 are identically configured to support articles such as bowls or other articles that require greater separation between the pegs. The second sets of pegs 110 and 114 are identically configured to support standard articles such as plates that do not require a large separation between the pegs. The pivoted divider members 100 can be made from plastic, wire or other material or a combination of materials having suitable strength.

The first and the second sets of pegs 108 and 110 are alternately positioned laterally along the first axle 102 with the first set of pegs 108 extending radially from the first axle 102 and the second set of pegs 110 also extending radially from the first axle 102 but at substantially 90° from the first set of pegs 108. Similarly, the first and the second sets of pegs 112 and 114 are alternately positioned laterally along the second axle 104 with the first set of pegs 112 extending radially from the second axle 104 and the second set of pegs 114 also extending radially from the second axle 104 but at substantially 90° from the first set of pegs 112. The placement of the first sets of pegs 108 and 112 at 90° with respect to the second sets of pegs 110 and 114 prevents the first and the second axles 102 and 104 from further rotation when the pivoted divider members 100 are placed in either the first or the second positions since either the first sets of pegs 108 and 112 or the second sets of pegs 110 and 114 will lie generally parallel to the bottom support means of either the upper or lower dish rack 14 or 16 (shown in FIGS. 2 and 6). The first sets of pegs 108 on the first axle 102 and 112 on the second axle 104 are located directly across from one another. The second sets of pegs 110 on the first axle 102 are offset from the second sets of pegs 114 on the second axle 104 by a minimum of the diameter of a peg or about one-quarter of an inch to prevent interference between the second sets of pegs 110 and 114 when the divider members 100 are rotated to the first position as shown in FIG. 10. There is no need to offset the first sets of pegs 108 and 112 since the first sets of pegs 108 and 112 are rotated away from each other as shown in FIG. 11.

Connecting the first axle 102 and the second axle 104 are pivot support members 106. The pivot support members 106 are molded from a suitable plastic material and are attached between adjacent longitudinal wire members of either the upper dish rack 14 (shown in FIG. 2) or the longitudinal wire members of the lower dish rack 16 (shown in FIG. 6). The pivot support members 106 each have a pair of depending legs 116 with notches or grooves 118 for engagement with the adjacent longitudinal wire members of a dish rack. The pivot support members 106 also include a body portion 120 extending transversely between and interconnecting the pair of depending legs 116. Extending outwardly and downwardly from the top of the body portion 120 of the pivot support member 106 is a locating tab 122 which engages one of the lateral wire members of either the upper or lower dish racks 14 or 16 shown in FIGS. 2 or 6. The locating tab 122 retains the pivot support member 106 parallel to and in close proximity to a lateral wire member.

Each pivot support member 106 further includes a pair of pivot retainer clips 124. The pivot retainer clips 124 include a slotted aperture 126 and a molded tab 128 useful for spreading open the slotted aperture 126 of the pivot retainer clip 124 to accept the axle portion 102 or 104 of the pivoted divider members 100. Juxtaposed to the slotted aperture 126 is a generally arcuately shaped cantilevered spring arm 130. The spring arm 130 is attached to the body portion 120 of the pivot support member 106 and defines a generally C-shaped biasing member 132. The free end of the C-shaped biasing member 132 includes a substantially V-shaped cam lobe 134 spaced above the slotted aperture 126. The upper portion of the C-shaped biasing member 132 further includes a substantially inverted V-shaped cam lobe 135.

The first and second axles 102 and 104 include a follower arm 136 extending into the interior of the C-shaped biasing member 132. The follower arm 136 is enclosed by a cylindrical plastic sleeve (not shown) for reducing frictional abrasion as the follower arm 136 contacts the V-shaped cam lobe 134 and the inverted V-shaped cam lobe 135.

Figure 14:
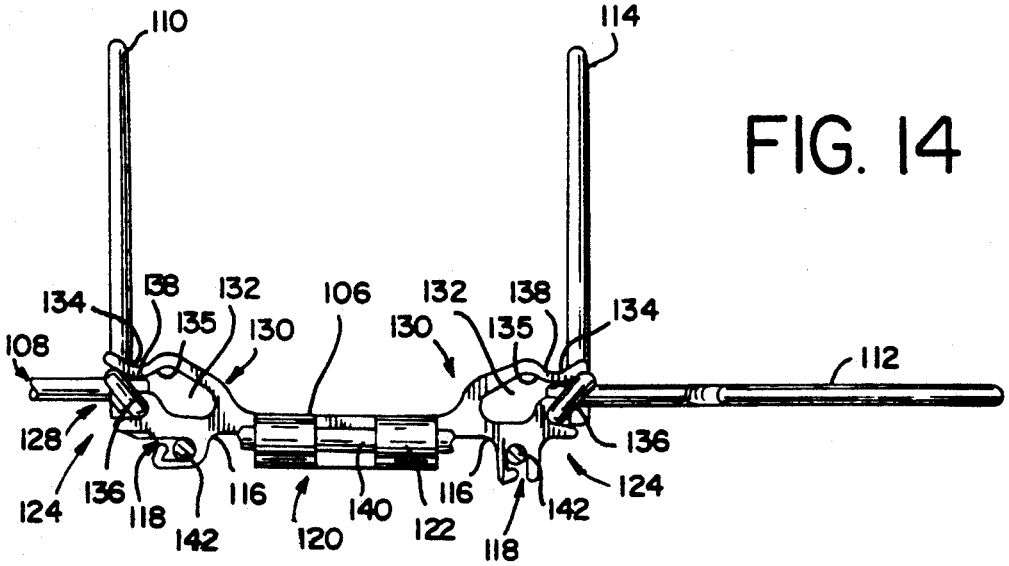
FIG. 14 is a side view of the pivot support means retaining the divider members in a second position.

The rotation of the pivoted divider members 100 to the second position as shown in FIGS. 11 and 14 will effect arcuated movement of the follower arm 136 within the interior of the C-shaped biasing member 132 so that the follower arm 136 will contact the highest point of the inverted V-shaped cam lobe 135 and the inside edge of the V-shaped cam lobe 134. Continued rotation of the pivot divider members 100 will effect upward deformation or flexing of the C-shaped biasing member 132 from the undeformed condition shown in FIGS. 10 and 12 until the spring force of the C-shaped biasing member is overcome and the follower arm has moved past the center 138 of the V-shaped cam lobe 134. The rotation will continue since the biasing effect of the flexed C-shaped biasing member 132 will tend to move the pivoted divider members 100 into the second position shown in FIGS. 11 and 14.

Figure 12:
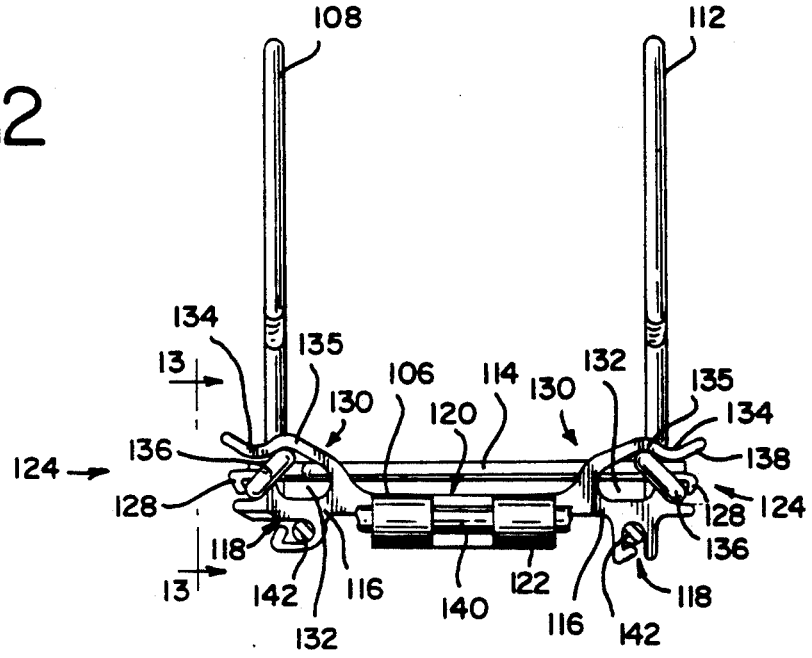
FIG. 12 is a side view of a pivot support means retaining the divider members in a first position.

Rotation of the pivoted divider members 100 in the opposite sense will move the pivoted divider members 100 from the second position shown in FIGS. 11 and 14 to the first position shown in FIGS. 10 and 12. Initial pivotal movement of the pivoted divider members 100 must overcome the downward biasing force of the deformed C-shaped biasing member 132. Once the follower arm 136 has been moved past the center 138 of the V-shaped cam lobe 134, the natural downward movement of the C-shaped biasing member 132 returning to its normal undeformed condition will force the pivoted divider members 100 to pivot toward the first position of FIGS. 10 and 12. It can thus be seen that the biasing force of the C-shaped biasing member 132 the cam lobes 134 and 135 associated therewith control the first and the second position of the pivoted divider members 100 dependent upon which side of the center 138 of the V-shaped cam lobe 134 the follower arm 136 is on. The first and the second sets of pegs can thus be moved from the first position to the second position and vice versa with one hand without releasing any locking mechanisms.

FIG. 12 is a side view of a pivot support means 106 retaining the pivoted divider members 100 in a first position. The first sets of pegs 108 and 112 are upright and the second sets of pegs 110 and 114 are folded-down and parallel to the lateral wire member 140 which can be found in either the upper or lower dish rack shown in FIGS. 2 and 6. The grooves 118 at the opposing ends of the depending legs 116 engage longitudinal wire members 142 to attach the pivoted divider members 100 to a dish rack. The locating tab 122 engages a lateral wire member 140 of a dish rack to prevent the pivoted divider members from sliding along the lateral wire members 142. The slotted apertures 126 have the first and second axles 102 and 104 extending therethrough. Extending from the first and second axles 102 and 104 are follower arms 136 extending into the interior of the C-shaped biasing member 132. It can be seen that when the pivoted divider members 100 are in the second position as illustrated, the C-shaped biasing member 132 has returned to its natural undeformed condition.

Figure 13:
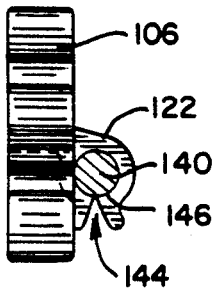
FIG. 13 is a cross section view of the pivot support means shown in FIG. 12.

FIG. 13 is a cross section view of the pivot support means 106 shown in FIG. 12. The locating tab 122 engages the lateral wire member 140 in a snap type device. Specifically, tabs 144 are spread apart to allow the lateral wire member 140 to snap into a recess 146. Once the lateral wire member 140 is snapped into the recess 146, the tabs 144 close around the lateral wire member 140. In order to remove the wire member 140, the tabs 144 must be spread apart.

FIG. 14 illustrates the pivot support means 106 retaining the pivoted divider members 100 in a second position. The first sets of pegs 108 and 112 have been rotated 90° so that the first sets of pegs 108 and 112 lie parallel to the bottom support means of a dish rack. The second sets of pegs 110 and 114 are now upright. The follower arms 136 now contact the outside edge of the V-shaped cam lobe 134. The rotation of the pivoted divider members 100 to the first position effects an upward deformation of the C-shaped biasing member 132 from the undeformed condition shown in FIG. 12 until the spring force of the C-shaped biasing member is overcome and the follower arm 136 has moved past the center 138 of the V-shaped cam lobe 134.

The pivoted divider members 100 are manually positionable between a first position and a second position. When the pivoted divider members 100 are rotated to the first position as shown in FIGS. 10 and 12, the first sets of pegs 108 and 112 are upright. These pegs are configured to allow deep articles such as bowls to be positioned between peg sets. When the pivoted divider members 100 are rotated to the second position as shown in FIGS. 11 and 14, the second sets of pegs 110 and 114 are upright. These pegs are configured to allow regular articles such as dinner plates to be positioned between peg sets. Flexibility is thus provided to configure a dish rack to accommodate varying load requirements.

While this invention has been shown and described in connection with preferred embodiments, it is apparent that certain changes and modifications, in addition to those mentioned above, may be made from the basic features of the present invention. Accordingly, it is the intention of the Applicant to protect all variations and modifications within the true spirit and valid scope of the present invention.

We claim:

1. A dishwasher rack comprising:

means defining a basic rack having a bottom wall including a plurality of spaced apart longitudinal and lateral wire members;

divider means including an axle portion; and means for pivotally mounting a pair of said divider means on said bottom wall in associated juxtaposition, each of said divider means further including a first plurality of pegs extending generally radially from said axle portion and having a first peg configuration and spacing for supporting a first type of dishes, each of said divider means still further including a second plurality of pegs extending generally radially from said axle portion at a position angularly spaced from said first plurality of pegs and having a second peg configuration and spacing for supporting a second type of dishes, said pair of divider means being pivotal between first and second positions for selectively supporting either said first or second types of dishes.

2. A dishwasher rack according to claim 1 wherein said first plurality of pegs is at substantially right angles to said second plurality of pegs.

3. A dishwasher rack according to claim 1 wherein said first and second plurality of pegs extend generally vertical in said dish supporting positions.

4. A dishwasher rack according to claim 1 wherein said first and said second plurality of pegs are alternately positioned along said axle portion.

5. A dishwasher rack according to claim 1 wherein said first plurality of pegs on one of said divider means is offset from said first plurality of pegs on the other divider means to avoid interference of said pegs when said divider means is pivoted from said first position to said second position.

6. A dishwasher rack according to claim 5 wherein said first plurality of pegs on one of said divider means is offset from said first plurality of pegs on the other divider means by one-quarter of an inch.

7. A dishwasher rack according to claim 5 wherein said first plurality of pegs on one of said divider means is offset from said first plurality of pegs on the other divider means by at least the diameter of a peg.

8. A dishwasher rack comprising:

means defining a basic rack having a bottom wall including a plurality of spaced-apart longitudinal and lateral wire members;

divider means including an axle portion; and means for pivotally mounting a pair of said divider means on said bottom wall in associated juxtaposition, each of said divider means further including a first plurality of pegs extending generally radially from said axle portion and having a first peg configuration and spacing for supporting a first type of dishes, each of said divider means still further including a second plurality of pegs extending generally radially from said axle portion at substantially a right angle to said first plurality of pegs and having a second peg configuration and spacing for supporting a second type of dishes, said pair of divider means being pivotal between first and second positions for selectively supporting either said first or second types of dishes.

9. A dishwasher rack according to claim 8 wherein said means for pivotally mounting a pair of said divider means comprises at least one unitary support member for pivotally supporting one end portion of said divider means on said bottom wall for movement between said first position and said second position, said support member including a body portion and integral attaching means engageable with said wire members of said basic rack for attaching said support member to said bottom wall, means integral with said body portion defining at least one pivot aperture for receiving an end portion of said divider means, means for receiving and pivotally supporting the other end portion of said divider means, and combination camming and resilient biasing means integral with said body portion and engageable with a portion of said divider means comprising a follower arm for biased movement thereof from an intermediate position toward either said first or said second positions.

10. A dishwasher rack according to claim 9 wherein said combination camming and biasing means includes a substantially V-shaped cam lobe, said biasing means of said combination being deformed as said follower arm contacts said cam lobe to urge said divider means toward either said first or said second position.

11. A dishwasher rack according to claim 9 wherein said combination camming and biasing means is generally C-shaped and includes a substantially V-shaped cam lobe formed in the top portion of said C-shape, the top portion of said C-shape being deformed as said follower arm contacts the lowest point of said cam lobe to urge said divider means towards either said first or said second position.

* * * * *